US005170215A

United States Patent [19]

Pfeuffer

[11] Patent Number: 5,170,215

[45] Date of Patent: Dec. 8, 1992

[54] ELECTROPHOTOGRAPHIC PRINTER WITH MEDIA SPEED CONTROL DUE TO VARIANCE IN FUSER TEMPERATURE

[75] Inventor: Joseph J. Pfeuffer, Spokane, Wash.

[73] Assignee: Output Technology Corporation, Spokane, Wash.

[21] Appl. No.: 770,670

[22] Filed: Oct. 1, 1991

[51] Int. Cl.[5] ..... G03G 15/20

[52] U.S. Cl. ..... 355/285; 355/208; 219/216; 219/388

[58] Field of Search ..... 355/282, 285, 289, 290, 355/295, 208; 432/60; 219/216, 388

[56] References Cited

U.S. PATENT DOCUMENTS

| | | | |
|---|---|---|---|
| 3,698,006 | 7/1972 | Ovshinsky | 46/74 |
| 4,257,053 | 3/1981 | Gilbreath | 346/108 |
| 4,319,874 | 3/1982 | Sawano | 432/60 |
| 4,549,803 | 10/1985 | Ohno et al. | 219/216 X |
| 4,618,242 | 10/1986 | Yamagishi | 219/216 X |
| 4,912,490 | 3/1990 | Negoro et al. | 346/160 |

*Primary Examiner*—Richard L. Moses

*Attorney, Agent, or Firm*—Wells, St. John, Roberts, Gregory & Matkin

[57] ABSTRACT

A continuous-form electrophotographic printer 10 for printing an image onto a continuous-form media 12 includes a media motion assembly 53 which moves the continuous-form media 12 at a velocity initially past an image transfer station 20 and then past an image fixing station 22. An image transfer assembly 28 at the image transfer station 20 transfers an electrophotographic image onto the continuous-form media 12. The media motion assembly 53 includes a roller-fusing assembly 42 at the image fixing station 22 to affix the electrophotographic image to the continuous-form media 12. The roller-fusing assembly 42 includes a fuser roller 44 heated to a predetermined temperature and a fuser temperature sensor 47 adjacent the fuser roller to monitor the fuser temperature. The printer 10 also includes a speed control system 52 which adjusts the velocity of the media (by changing the rotational speed of the motor 50) in accordance with the fuser temperature sensed by the fuser temperature sensor to obtain a predetermined optimum media velocity.

12 Claims, 3 Drawing Sheets

ELECTROPHOTOGRAPHIC PRINTER WITH MEDIA SPEED CONTROL DUE TO VARIANCE IN FUSER TEMPERATURE

TECHNICAL FIELD

The present invention relates to continuous-form electrophotographic printers.

BACKGROUND OF THE INVENTION

Conventional electrophotographic printers are constructed with an image fixing station spaced downstream from an image transfer station. Print media, such as paper, is moved through the image transfer station and then through the image fixing station. At the image transfer station, an electrophotographic image is transferred to the print media. At the image fixing station, the image is affixed to the print media. The print media is moved through the stations by a media motion assembly which typically includes a roller assembly located at the image fixing station, a guidance system positioned intermediate of the image transfer station and the image fixing station, and a motor connected to drive the roller assembly and the guidance system.

To form an electrophotographic image on a print media, an image forming device at the image transfer station places multiple scan lines at a preset scan rate on a cylindrical photoconductive drum. A series of scan lines forms an electrostatic image on the drum. The drum is then rotated past a toner applicator which applies a toner or ink powder to the electrostatic image. The drum is next rotated adjacent the print media to transfer the toner image to the print media, which is moving through the image transfer station and past the drum at a constant velocity. Thereafter, the media is moved through the image fixing station wherein the roller-fusing assembly fuses the toner image onto the media.

The roller-fusing assembly includes a fuser roller and a pressure roller. The media is passed between the two rollers and moved by the rotation of the two rollers. The fuser roller is heated to a predetermined temperature conducive to fusing the toner image onto the media.

The velocity of the media past the image transfer station must be constant; otherwise, image quality is severely diminished. The media velocity is independent of the scan rate of the image forming device. For optimum printing quality, the media velocity and the scan rate should be synchronized. For example, in one electrophotographic printer, the optimum printing synchronization may be 300 scan lines per inch of print media. Accordingly, the optimum media velocity is that which permits the drum to transfer 300 scan lines per inch to the print media as the media moves past the image transfer station.

Although a velocity allowing the optimum number of scan lines per inch is ideal, many factors influence the printer to alter slightly the velocity of the media. One of the factors is fuser temperature in the fuser roller. As the fuser temperature changes, the fuser roller expands and contracts about its radial axis. This change in radial dimensions affects the velocity at which the media moves between the fuser roller and the pressure roller.

Prior art electrophotographic printers make no adjustment to media velocity for fluctuations in the fuser temperature.

An advantage of the present invention is to provide an electrophotographic printer which adjusts the media velocity for fluctuations in the fuser temperature. In this manner, the optimum media velocity is maintained throughout the printing process.

These and other advantages of this invention will become apparent upon reading the following detailed description of a preferred embodiment.

BRIEF DESCRIPTION OF THE DRAWINGS

The preferred embodiment of the invention is described below with reference to the accompanying drawings, wherein like numerals reference like elements, in which.

DETAILED DESCRIPTION OF THE PREFERRED EMBODIMENTS

Figure 1:
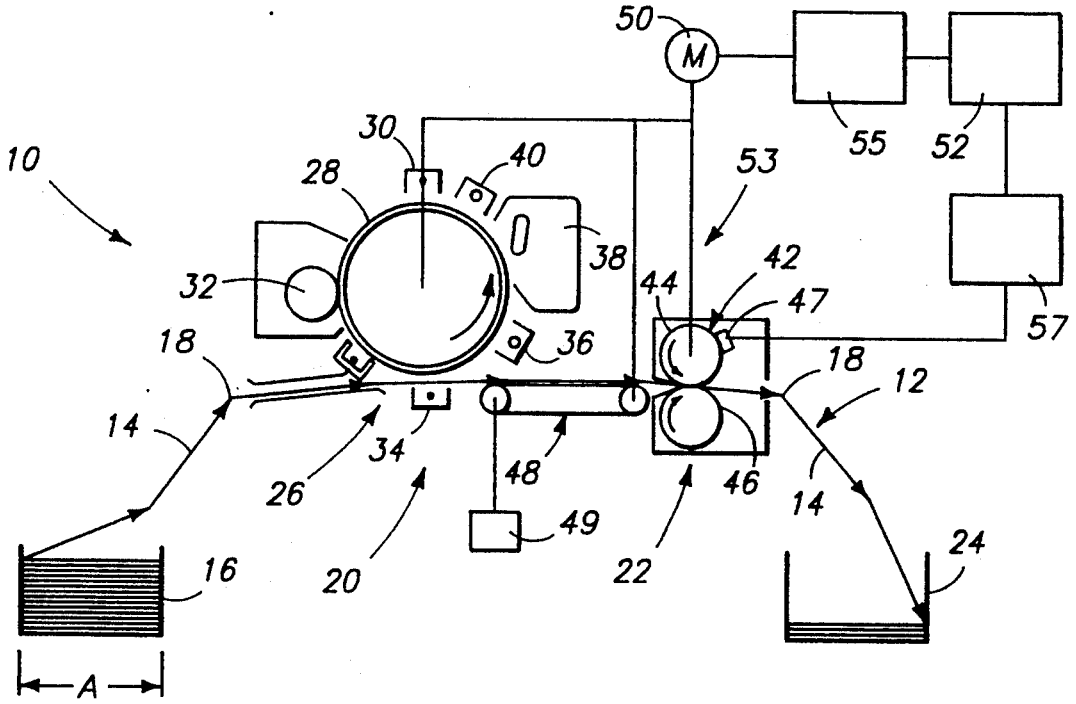
FIG. 1 is a side elevation schematic of a preferred embodiment of a continuous-form electrophotographic printer of the present invention illustrating the continuous-form media being initially conveyed past an image transfer station and then past an image fixing station to print images onto individual sheets of the continuous-form media.
Figure 2:
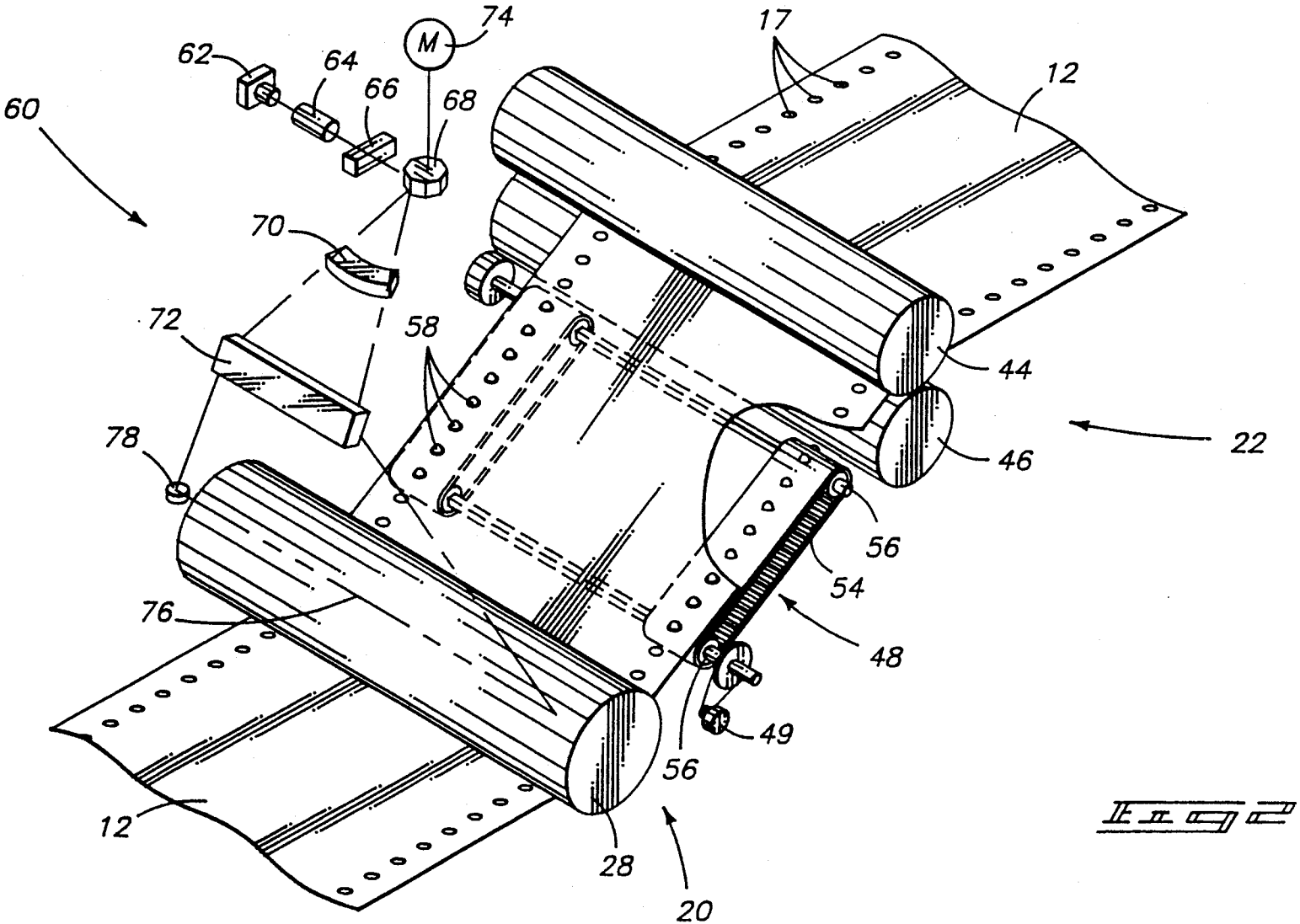
FIG. 2 is a perspective view of the electrophotographic printer of the present invention illustrating an image forming device employed therein.

FIGS. 1 and 2 illustrate a preferred embodiment of an electrophotographic printer 10 designed to print on a continuous-form media 12. Preferably, the continuous-form media 12 is a "fan-folded" type having individual sheets (depicted as an arrow 14) interconnected at leading and trailing edges. Alternatively, the continuous-form media 12 may be one continuous sheet which is later cut to form individual sheets.

The individual sheets 14 are interconnected at an intersheet boundary 18, which is preferably defined by perforations that enable each sheet 14 to be readily separated from the adjacent sheet of the continuous-form media 12 after the printing has been completed. Each of the individual sheets 14 has feed perforations or holes 17 formed therein to facilitate accurate movement of the continuous-form media 12 relative to the printer 10.

As shown in FIG. 1, the continuous-form media 12 is moved from an unprinted storage container 16, past an image transfer station 20 and an image fixing station 22, and deposited into a printed storage container 24. The printer 10 has an image transfer assembly 26 at the image transfer station 20 for transferring an electrophotographic image from an optical photo conductor (OPC) transport or drum 28 onto the individual sheets 14. The OPC drum 28 preferably includes photoreceptors for producing an electrostatic image on the outer periphery of the drum. The image is generated by an image generator 30, such as a laser or an array of LEDs. The peripheral portion of the drum 28 passes a developer or toner applicator 32 which places a toner or dry ink material on the drum 28 to form a toner image. A discharger 34 is located at the image transfer station 20 opposite the drum 28 for transferring the toner image from the drum 28 to the individual sheets 14 as the drum 28 is rotated and the sheets 14 pass through the image transfer station 20.

The image transfer assembly 26 further includes a charge eliminating electrode 36 positioned downstream of the path of the drum 28 for discharging the photoreceptors subsequent to the image transfer. A drum cleaning unit 38 is positioned farther downstream of the movement of the drum 28 to remove any excess or remaining toner or dry ink to prepare the drum 28 for a new image. A charging electrode 40 is utilized downstream of the drum cleaning unit 38 to recharge the photoreceptors on the drum 28.

The printer 10 also includes a roller-fusing assembly 42 at the image fixing station 22 for fusing the toner or dry ink powder to the individual sheets 14 to complete the printing process. The roller-fusing assembly 42 includes a fuser roller 44 that is heated to a temperature sufficient to fuse the toner as the sheets 14 pass through the image fixing station 22. In conjunction with the fuser roller 44, a pressure roller 46 presses the continuous-form media 12 firmly against the fuser roller 44 to increase the heat conductivity from the fuser roller 44 to the sheet 14.

A fuser temperature sensor 47 is disposed adjacent the fuser roller 44 to measure the fuser temperature at the surface of the fuser roller 44. The fuser temperature sensor 47 outputs a temperature signal to the speed control circuit 52, which is described below in more detail. The fuser temperature sensor 47 is preferably a thermistor which changes resistance in proportion to changes in temperature and outputs a variable voltage in relation to the resistance changes. Accordingly, an analog-to-digital (A/D) converter 57 is preferably positioned in the path from the fuser temperature sensor 47 to the speed control circuit 52.

The printer 10 preferably includes a tractor assembly 48 positioned intermediate of the image transfer station 20 and the image fixing station 32, although other guidance systems may be employed. The tractor assembly 48 guides the continuous-form media 12 from the image transfer station 20 to the image fixing station 22. As shown in FIG. 2, the tractor assembly 48 includes a pair of belts 54 between pulleys 56. The belts 54 have projections 58 which project through the holes 17 in the continuous-form media 12 to facilitate movement and alignment of the media 12.

A media motion sensor 49 is connected to the tractor assembly 48 to measure the movement of the continuous-form media 12. The media motion sensor 49 outputs a motion signal each time the continuous-form media 12 moves a predetermined segment of media. For example, the media motion sensor 49 may output the motion signal every time the continuous-form media 12 is moved one-half inch. In the preferred embodiment, the media motion sensor 49 is a tachometer.

A stepper motor 50 drives the drum 28, the fuser roller 44, and the tractor assembly 48. Preferably, the stepper motor 50 drives the drum 28 and the fuser roller 44 at the same rotational speed, and the tractor assembly 48 at a slightly slower speed to provide appropriate drag on the continuous-form media 12. The drag prevents the continuous-form media 12 from "bubbling" or "bowing" at the roller-fuser assembly 42. The tractor assembly 48 further includes a slip clutch (not shown) which enables the belts 54 to be moved at the speed of the continuous-form media 12. In other embodiments, the stepper motor 50 may drive only the fuser roller 44, or the fuser roller 44 in combination with either the drum 28 or the tractor assembly 48. In still another embodiment, multiple stepper motors may be employed, whereby one stepper motor is employed to drive the fuser roller 44 and a second stepper motor is employed to drive the drum 28.

The stepper motor 50 and the fuser roller 44 compose a media motion assembly 53 which moves the continuous-form media 12 past the image transfer station 20 and the image fixing station 22 at a constant velocity. The media motion assembly 53 may also include the tractor assembly 48.

A speed control system 52 is operatively coupled through an incremental media motion driver circuit 55 to control the rotational speed of the stepper motor 50. The speed control system 52 is described in more detail with reference to FIG. 3.

As shown in FIG. 2, an image forming device 60 at the image transfer station 20 includes a laser 62, a collimator lens 64, a beam shaper 66, a polygonal mirror 68, a lens 70, and a reflecting mirror 72. The polygonal mirror 68 is rotated by a motor 74 at a constant scan rate. As the polygonal mirror 68 is rotated, a scan line 76 is placed on the drum 28. A scan line sensor 78 is positioned adjacent the drum 28 to sense completion of a scan line 76. The scan line sensor 78 outputs a scan line signal to the speed control system 52 as will be described below in more detail below.

The image forming device 60 places multiple scan lines 76 on the drum 28. The scan lines combine to form electrophotographic images which are transferred by the drum 28, past the toner applicator 32, and onto the continuous-form media 12.

As mentioned above, the motor 74 rotates the polygonal mirror 68 at a constant scan rate. Also, the media motion assembly 53 moves the continuous-form media 12 past the image transfer station 20 at a constant velocity. The number of scan lines placed on any given segment of the continuous-form media 12 is therefore dependent upon the synchronization of the scan rate and the velocity of the continuous-form media 12 past the image forming station 20. For example, to obtain 300 scan lines per inch, the velocity of the continuous-form media 12 must be such that 300 scan lines are transferred from the drum 28 in a one inch segment of the continuous-form media 12.

Figure 3:
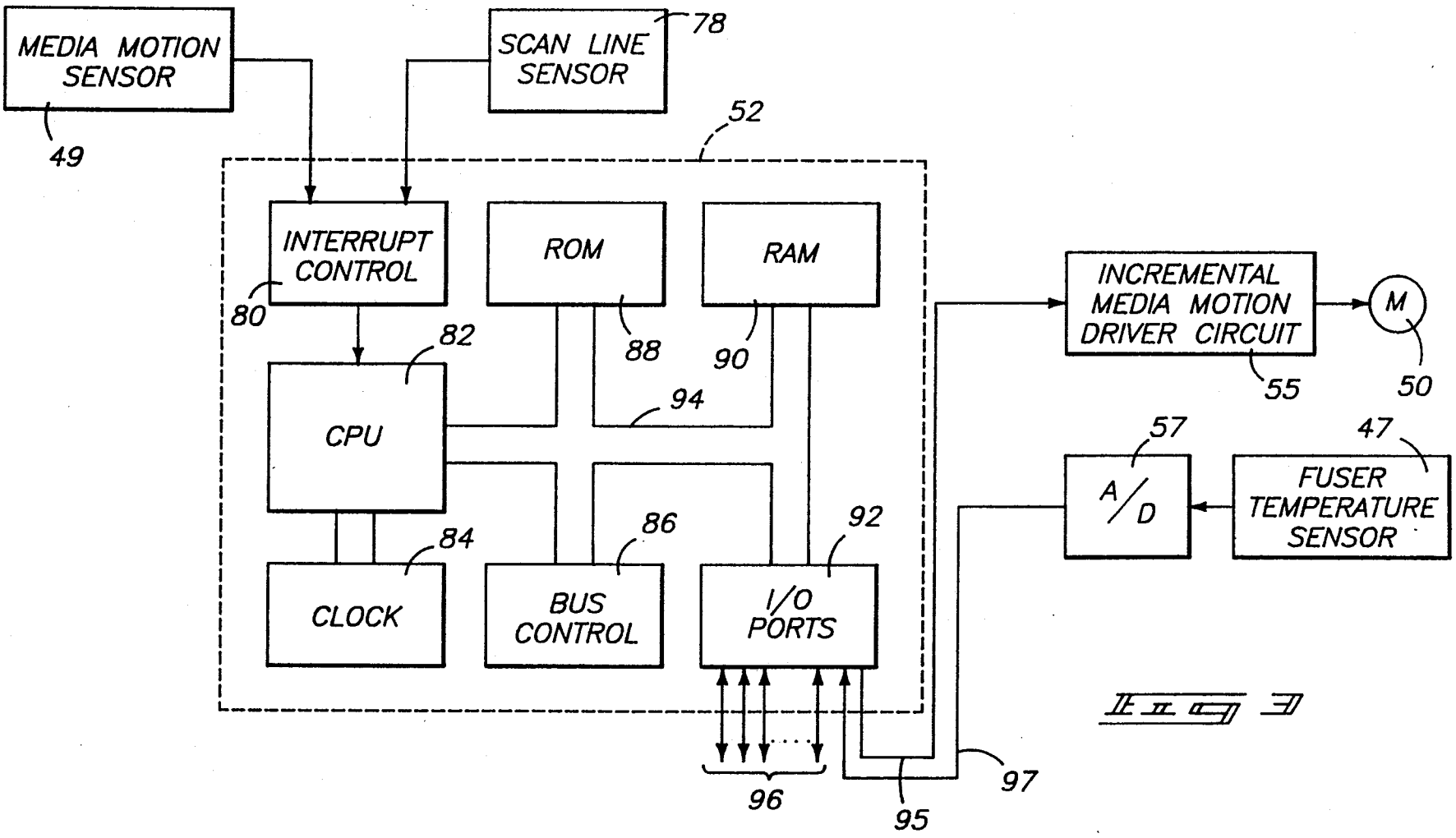
FIG. 3 is a block diagram of a speed control system used in the printer of the present invention.

FIG. 3 illustrates the speed control system 52 according to the preferred embodiment of the present invention. The speed control system comprises an interrupt control 80, a CPU 82, a clock 84, a BUS control 86, a read-only memory (ROM) 88, a random access memory (RAM) 90, an I/O port 92, and a bus 94. The interrupt control 80 is coupled to receive the motion signal from the media motion sensor 49 and the scan line signal from the scan line sensor 78. The I/O port 92 is coupled to multiple I/O lines 95–97 to interact with other printer components. The I/O port 92 outputs speed control signals over the I/O line 95 to the incremental media motion driver circuit 55 to drive the stepper motor 50 at desired rotational speeds. The I/O port 92 receives converted fuser temperature signals over the I/O line 97 from the fuser temperature sensor 47. The remaining I/O lines 96 are coupled to other printer components, including a raster image processor, a scanning driver, and various printer sensors which are not described herein, but are generally known to those skilled in the art.

The operation of the electrophotographic printer of the present invention will now be described. The fuser temperature sensor 47 measures the fuser temperature at the surface of the fuser roller 44. The fuser temperature sensor 47 generates fuser temperature signals which are proportional to the fuser temperature, and therefore change as the fuser temperature changes. The change in fuser temperature affects the velocity of the media through the printer because the fuser roller 44 radially expands or contracts in response to temperature variations. The fuser temperature signals are monitored by the speed control system 52. Depending upon the fuser temperature, the speed control system 52 adjusts the rotational speed of the stepper motor 50. In this manner, the printer 10 is able to maintain the optimum media velocity regardless of temperature fluctuations in the fuser roller 44.

In the preferred embodiment, the speed control system 52 derives adjustment values used to adjust the speed of the stepper motor 50 by examining a look-up table stored in the ROM 88. The table includes a series of pre-computed adjustments values in relation to different fuser temperatures. When the fuser temperature changes, the speed control system 52 simply reads from the table the ideal rotational speed for that particular temperature. The speed control system 52 then outputs a speed change signal to the media motion driver circuit 55 to alter the rotational speed of the stepper motor 50. As a result, the continuous-form media 12 is moved through the printer 10 at the optimum constant velocity.

If certain fuser temperatures are not specifically listed on the table, the speed control circuit 52 can interpolate from the existing table values. The interpolation may be a first degree interpolation or a second degree interpolation, depending upon the accuracy desired. The interpolation feature is significant because not every fuser temperature needs to be stored in memory, thereby reducing the amount of memory necessary to store the look-up table.

As an alternative to using a look-up table, the present invention may employ an algorithm to compute a velocity change which compensates for the fuser temperature. However, employing a look-up table is advantageous in terms of processing speed.

The speed control system 52 can also use the motion signals output by the media motion sensor 49 and the scan line signals output by the scan line sensor 78 as a feedback measure to determine if the adjusted rotational speed provides the optimum media velocity. The motion signal is output at equal intervals of movement. For example, the motion signal may be output as the media moves one-half inch. The control system 52 counts the number of scan line signals received between receipt of each motion signal to compute the actual number of scan lines per segment of media. For example, the control system 52 may count 150 scan lines per one-half inch. The speed control system 52 can then compare the actual number of scan lines per segment with an optimum number of scan lines per segment stored in the ROM 88. In this manner, when the speed control system 52 changes the rotational speed of the stepper motor 50 to effectuate a change in the media velocity, the speed control system 52 can monitor the motion signals and the scan line signals to ensure that this rotational speed change did in fact effectuate the desired velocity change.

Carrying this procedure one step farther, the speed control system 52 could update the table based on information gained from the media motion sensor 49 and the scan line sensor 78. For example, suppose the printer 10 optimally prints at 150 scan lines per one-half inch and a change in the fuser temperature results in a media velocity of 149 scan lines per one-half inch. As temperature signals are received from the fuser temperature sensor 47, the speed control circuit 52 changes the speed of the stepper motor 50 in accordance with adjustment values obtained from the look-up table. Unfortunately, the speed change does not adequately correct the media velocity, which remains at 149 scan lines per one-half inch. Using the information from the motion sensor 49 and the scan line sensor 78, the speed control circuit could alter the adjustment value stored in the memory so that when the same fuser temperature is sensed next time, the table will have a more appropriate adjustment value corresponding to that fuser temperature. Of course, to accommodate changes in the table, a programmable ROM (such as an EEPROM) should be employed.

The printer according to the present invention is advantageous over the prior art printers in that print quality is not diminished due to speed changes caused by fluctuations in fuser temperature. The printer of the present invention adjusts the velocity of the print media as the fuser temperature changes.

In compliance with the statute, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A continuous-form electrophotographic printer for printing an image onto a continuous-form media, the printer comprising:

a media motion assembly for moving the continuous-form media at a velocity initially past an image transfer station and then past an image fixing station;

an image transfer assembly at the image transfer station for transferring an electrophotographic image onto the continuous-form media;

the media motion assembly including a roller-fusing assembly at the image fixing station for affixing the electrophotographic image to the continuous-form media;

the roller-fusing assembly including a fuser roller heated to a predetermined fuser temperature and a fuser temperature sensor adjacent the fuser roller to monitor the fuser temperature; and a speed control system for adjusting the velocity of the media in accordance with the fuser temperature sensed by the fuser temperature sensor to obtain a predetermined optimum media velocity, the speed control system including a memory which stores a table of adjustment values in relation to different fuser temperatures, the speed control system adjusting the velocity of the media by selecting an adjustment value from the table based upon the fuser temperature.

2. A continuous-form electrophotographic printer according to claim 1 wherein the speed control system interpolates between two fuser temperatures listed on the table to derive an adjustment value not listed on the table.

3. A continuous-form electrophotographic printer according to claim 1 further comprising:

a scan line sensor for sensing each scan line placed on the photoconductive image device by the image forming device and for outputting a scan line signal; and a media motion sensor for measuring movement of the media and outputting a motion signal when the media has moved a predetermined segment of media;

the speed control system counting a number of scan line signals received from the scan line sensor during an interval between receipt of a first motion signal and receipt of the next motion signal to compute an actual number of scan lines for the segment of media, the speed control system comparing the actual number of scan lines to an optimum number of scan lines for the segment of media and correcting the adjustment values in the table based upon this comparison.

4. A continuous-form electrophotographic printer for printing an image onto a continuous-form media, the printer comprising:

an image transfer assembly at the image transfer station for transferring an electrophotographic image onto the continuous-form media;

a roller-fusing assembly at an image fixing station downstream of the image transfer station for affixing the electrophotographic image to the continuous-form media, the roller-fusing assembly moving the continuous-form media at a velocity past the image transfer station;

the roller-fusing assembly including a fuser roller heated to a predetermined fuser temperature and a fuser temperature sensor adjacent the fuser roller to monitor the fuser temperature;

a stepper motor operatively connected to rotate the fuser roller at an optimum rotational speed that ensures an optimum velocity of the media past the image transfer station; and a speed control system operatively coupled to the stepper motor and to the fuser temperature sensor, the control system adjusting the rotational speed of the stepper motor to the optimum rotational speed in accordance with the fuser temperature sensed by the fuser temperature sensor to obtain the optimum media velocity, the speed control system including a memory which stores a table of speed adjustment values in relation to different fuser temperatures, the speed control system adjusting the rotational speed of the stepper motor by selecting a speed adjustment value from the table based upon the fuser temperature sensed by the fuser temperature sensor.

5. A continuous-form electrophotographic printer according to claim 4 wherein the speed control system interpolates between two fuser temperatures listed on the table to derive an adjustment value not listed on the table.

6. A continuous-form electrophotographic printer according to claim 4 further comprising:

a scan line sensor for sensing each scan line placed on the photoconductive image device by the image forming device and for outputting a scan line signal; and a media motion sensor for measuring movement of the media and outputting a motion signal when the media has moved a predetermined segment of media;

the speed control system counting a number of scan line signals received from the scan line sensor during an interval between receipt of a first motion signal and receipt of the next motion signal to compute an actual number of scan lines of the segment of media, the speed control system comparing the actual number of scan lines to an optimum number of scan lines for the segment of media and correcting the adjustment values in the table based upon this comparison.

7. A continuous-form electrophotographic printer for printing an image onto a continuous-form media, the printer comprising:

a media motion assembly for moving the continuous-form media at a velocity initially past an image transfer station and then past an image fixing station;

an image transfer assembly at the image transfer station for transferring an electrophotographic image onto the continuous-form media;

the media motion assembly including a roller-fusing assembly at the image fixing station for affixing the electrophotographic image to the continuous-form media;

the roller-fusing assembly including a fuser roller heated to a predetermined fuser temperature and a fuser temperature sensor adjacent the fuser roller to monitor the fuser temperature; and a speed control system for adjusting the velocity of the media in accordance with the fuser temperature sensed by the fuser temperature sensor to obtain a predetermined optimum media velocity, the speed control system having a memory for storing speed change information used by the speed control system to adjust the media velocity.

8. A continuous-form electrophotographic printer according to claim 7 wherein the memory stores an algorithm for computing velocity adjustment values based upon fuser temperature.

9. A continuous-form electrophotographic printer according to claim 7 wherein the memory contains a look-up table having a series of pre-computed velocity adjustment values arranged in relation to different fuser temperatures.

10. A continuous-form electrophotographic printer for printing an image onto a continuous-form media, the printer comprising:

an image transfer assembly at the image transfer station for transferring an electrophotographic image onto the continuous-form media;

a roller-fusing assembly at an image fixing station downstream of the image transfer station for affixing the electrophotographic image to the continuous-form media, the roller-fusing assembly moving the continuous-form media at a velocity past the image transfer station;

the roller-fusing assembly including a fuser roller heated to a predetermined fuser temperature and a fuser temperature sensor adjacent the fuser roller to monitor the fuser temperature;

a stepper motor operatively connected to rotate the fuser roller at an optimum rotational speed that ensures an optimum velocity of the media past the image transfer station; and a speed control system operatively coupled to the stepper motor and to the fuser temperature sensor, the control system adjusting the rotational speed of the stepper motor to the optimum rotational speed in accordance with the fuser temperature sensed by the fuser temperature sensor to obtain the optimum media velocity, the speed control system havin a memory for storing speed change information used by the speed control system to adjust the media velocity.

11. A continuous-form electrophotographic printer according to claim 10 wherein the memory stores an algorithm for computing velocity adjustment values based upon fuser temperature.

12. A continuous-form electrophotographic printer according to claim 10 wherein the memory contains a look-up table having a series of pre-computed velocity adjustment values arranged in relation to different fuser temperatures.

* * * * *